US006708630B2

(12) United States Patent
Zheng

(10) Patent No.: US 6,708,630 B2
(45) Date of Patent: Mar. 23, 2004

(54) FOLDABLE SIDE SUPPORT ARRANGEMENT FOR FOLDABLE FURNITURE

(76) Inventor: Edward Zheng, 1736 Wright Ave., La Verne, CA (US) 91750

( * ) Notice: Subject to any disclaimer, the term of this patent is extended or adjusted under 35 U.S.C. 154(b) by 40 days.

(21) Appl. No.: 10/178,664

(22) Filed: Jun. 25, 2002

(65) Prior Publication Data

US 2003/0233966 A1 Dec. 25, 2003

(51) Int. Cl.[7] ..... A47B 3/00
(52) U.S. Cl. ..... 108/115; 108/166
(58) Field of Search ..... 108/115, 118, 108/166, 120, 157.15, 162; 248/164, 436

(56) References Cited

U.S. PATENT DOCUMENTS 800,233 A * 9/1905 McConnell ..... 248/164
1,876,400 A * 9/1932 Cederquist ..... 108/118
6,073,894 A * 6/2000 Chen ..... 108/115
6,158,361 A * 12/2000 Zheng et al. ..... 108/118
6,192,809 B1 * 2/2001 Riach et al. ..... 108/115
6,505,565 B1 * 1/2003 Byung et al. ..... 108/115

FOREIGN PATENT DOCUMENTS

GB 2137490 * 10/1984

* cited by examiner

*Primary Examiner*—Jose V. Chen
(74) *Attorney, Agent, or Firm*—Raymond Y. Chan; David and Raymond Patent Group

(57) ABSTRACT

A foldable furniture incorporates with a foldable side support arrangement which includes a pair of side supporting units pivotally connected to two side frame of a foldable frame of the foldable furniture and a pair of retaining units coupling with the side supporting units respectively to reinforce the side supporting units pivotally extended to retain the first and second side frame legs of the side frame in position when the foldable frame is unfolded to stretch out wherein two side edge portions of a tension fabric are substantially supported by the two side supporting units respectively. Therefore, the foldable side supporting arrangement is capable of substantially increasing the supporting area of tension fabric to more evenly distribute and support the downward force and stress applied on the tension fabric.

20 Claims, 6 Drawing Sheets

FOLDABLE SIDE SUPPORT ARRANGEMENT FOR FOLDABLE FURNITURE

BACKGROUND OF THE PRESENT INVENTION

1. Field of Invention

The present invention relates to a foldable furniture, and more particularly to a foldable side support arrangement for a foldable furniture which is more comfortable and capable of supporting more weight comparing with the conventional foldable furniture.

2. Description of Related Arts

A conventional foldable furniture, such as a foldable bed, a foldable table, or a foldable chair, generally comprises a foldable frame constructed by metal tubes and a supporting fabric. The foldable frame comprises a plurality pairs of construction tubes for supporting the supporting fabric in a tense manner wherein each pair of construction tubes are pivotally connected together where they cross so that the foldable frame can be easily unfolded to provide a rigid cross-support for use and be folded for storage. Since the conventional foldable furniture can be quickly and easily unfolded for use and folded into a compact unit for carriage, the user can carry the foldable furniture to everywhere such as campground or beach.

However, the conventional foldable furniture has a major drawback. Since the supporting fabric is suspendedly supported by the foldable frame, the supporting fabric may not be substantially supported in a tense manner when the foldable furniture is in the unfolded condition. When a downward pulling force is applied on the supporting fabric, the supporting fabric will be stretched to the center thereof. Especially for the foldable bed, most of the users have an intention to plunge into the foldable bed downwardly when the downward pulling force of the weight of the user is exerted on the supporting fabric.

Furthermore, stresses are created by the downward pulling force at the connecting joints where the construction tubes are connected with each other. The user's weight causes the supporting fabric to be pulled away from the connecting joints such that stress will be created at the connecting joints. The stress will then cause a tear along the area of the supporting fabric at the connecting joint so that the supporting fabric will be permanently misshapen at the stress point over a period of continuous use.

SUMMARY OF THE PRESENT INVENTION

A main object of the present invention is to provide a foldable side support arrangement for a foldable furniture, wherein two side portions of the tension fabric are well supported by the foldable frame such that the foldable furniture is more comfortable and capable of supporting more weight in comparison with the conventional foldable furniture that has the same frame structure and size.

Another object of the present invention is to provide a foldable side support arrangement for a foldable furniture which substantially increases the supporting area of the tension fabric to more evenly distribute and support the downward force and stress applied on the tension fabric.

Another object of the present invention is to provide a foldable side support arrangement for a foldable furniture, wherein two side portions of the tension fabric are substantially supported by two foldable side supporting arm respectively in such a manner that the tension fabric allows a greater downward pulling force, such as the user's weight, applied on the tension fabric without distorting the shape thereof.

Another object of the present invention is to provide a foldable side support arrangement for a foldable furniture, wherein the two side supporting arms do not increase the ordinary size of the foldable furniture. Therefore, the foldable furniture of the present invention is adapted for being folded into a compact unit for carriage and storage and unfolded for use as usual.

Accordingly, in order to accomplish the above objects, the present invention provides a foldable furniture, comprising:

- a foldable frame, which comprises:
  - two side frames each comprising a first side frame leg and a second side frame leg pivotally coupled with each other to form a "X" structure;
  - a front frame comprising a first front frame leg and a second front frame leg pivotally coupled with each other to form a "X" structure;
  - a rear frame comprising a first rear frame leg and a second rear frame leg pivotally coupled with each other to form a "X" structure;
  - a pair of front frame joints pivotally connected two upper ends of the front frame legs with two upper ends of the side frame legs respectively; and
  - a pair of rear frame joints pivotally connected two upper ends of the rear frame legs with two upper ends of the side frame legs respectively; and
  - a foldable side support arrangement, which comprises:
    - a pair of side supporting units each comprising a first and second side supporting arms pivotally connected with each other end to end wherein a free end portion of the first side supporting arm is pivotally coupling with the upper end of the respective second side frame leg and a free end portion of the second side supporting arm is pivotally coupling with the upper end of the respective first side frame leg;
    - a pair of retaining units coupling with the side supporting units respectively to reinforce the side supporting units pivotally extended to retain the first and second side frame legs in position when the foldable frame is unfolded to stretch out; and
    - a tension fabric, which is supported on the foldable frame, having two side edge portions substantially supported by the two side supporting units respectively.

DETAILED DESCRIPTION OF THE PREFERRED EMBODIMENT

Figure 1:
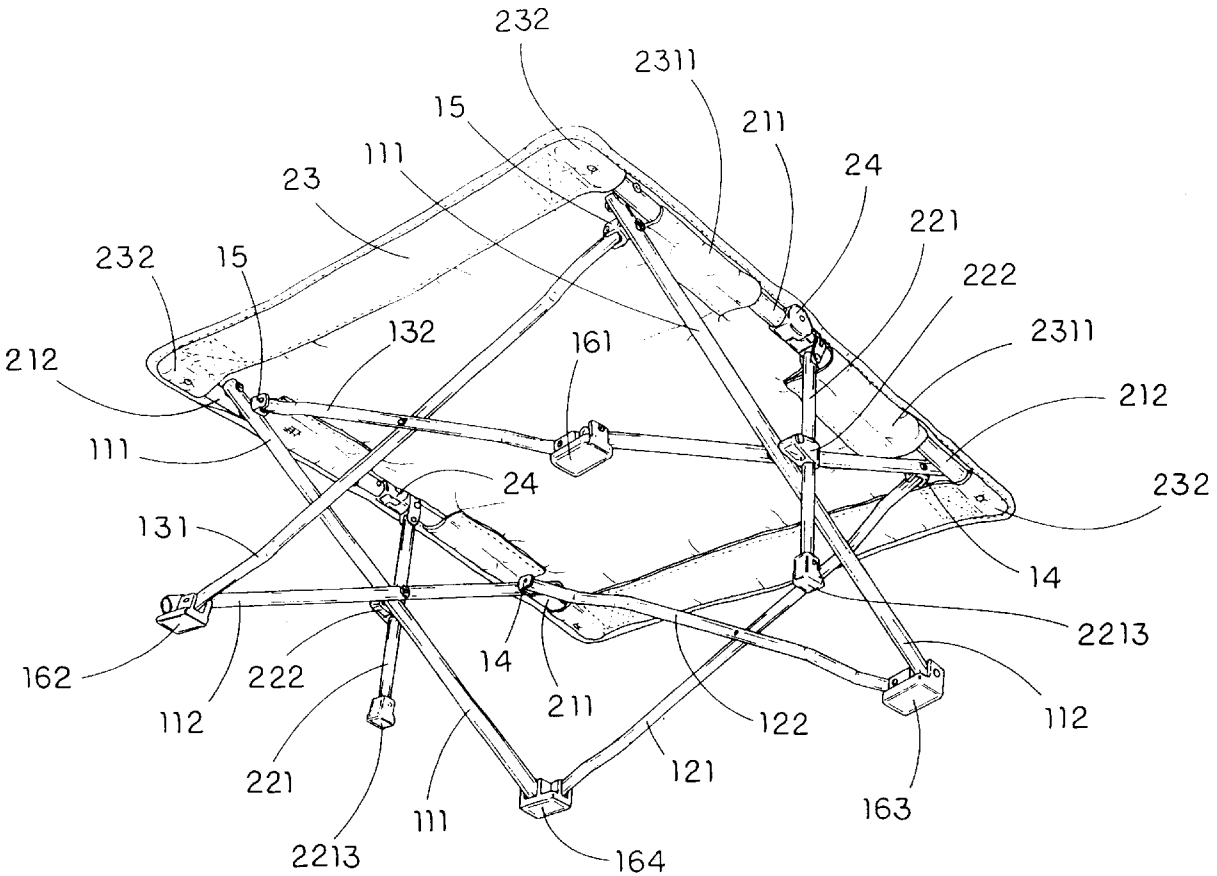
FIG. 1 is a perspective view of a foldable furniture incorporated with a foldable side support arrangement according to a first preferred embodiment of the present invention.

Referring to FIG. 1 of the drawings, a foldable furniture 1 incorporated with a foldable side support arrangement 20 according to a first preferred embodiment of the present invention is illustrated, wherein the foldable furniture 1 of the first embodiment, which is constructed as a foldable table, comprises a foldable frame 10 to support a tension fabric 23 thereon.

The foldable frame 10, such as a conventional foldable table frame, comprises two side frames 11 each comprising a first side frame leg 111 and a second side frame leg 112 pivotally coupled with each other to form a "X" structure, a front frame 12 comprising a first front frame leg 121 and a second front frame leg 122 pivotally coupled with each other to form a "X" structure, and a rear frame 13 comprising a first rear frame leg 131 and a second rear frame leg 132 pivotally coupled with each other to form a "X" structure.

The foldable frame 10 further comprises a pair of front frame joints 14 pivotally connected two upper ends of the front frame legs 121, 122 with two upper ends of the side frame legs 111 respectively and a pair of rear frame joints 15 pivotally connected two upper ends of the rear frame legs 131, 132 with two upper ends of the side frame legs 112 respectively.

The foldable frame 10 further comprises four base joints 161, 162, 163, 164, wherein the first and second base joints 161, 162 pivotally connect two bottom ends of the side frame legs 112 with two bottom ends of the front frame legs 121, 122 respectively and the third and fourth base joints 163, 164 pivotally connect two bottom ends of the side frame legs 111 with two bottom ends of the rear frame legs 131, 132 respectively.

Figure 2:
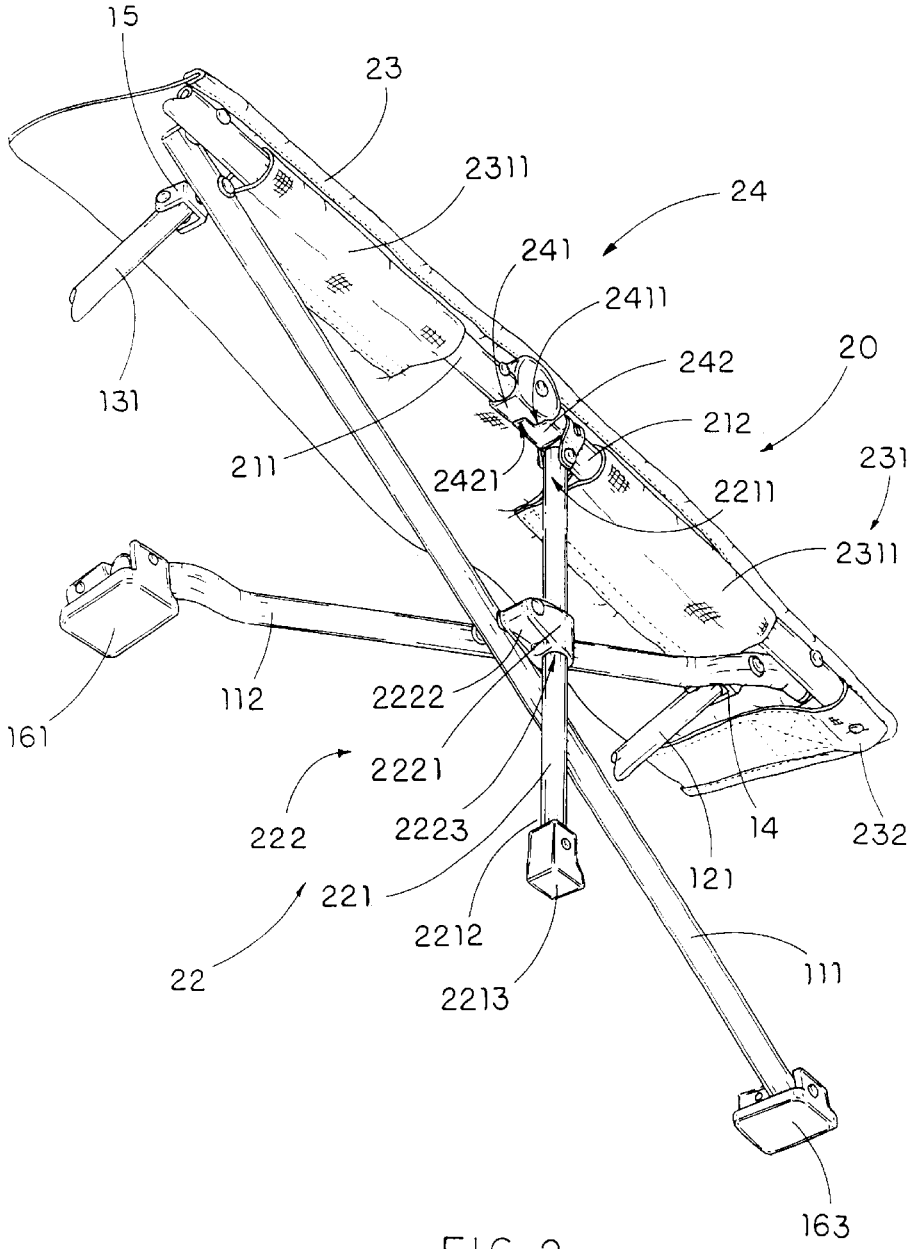
FIG. 2 is the foldable side support arrangement of the foldable furniture according to the above first preferred embodiment of the present invention.

As shown in FIG. 2, the foldable side support arrangement 20 comprises a pair of side supporting units 21 and a pair of retaining units 22 coupling with the side supporting units 21 respectively to reinforce the side supporting units 21 pivotally extended to retain the first and second side frame legs 11, 12 in position when the foldable frame 10 is unfolded to stretch out.

Each of the side supporting units 21 comprises a first and second side supporting arms 211, 212 pivotally connected with each other end to end wherein a free end portion of the first side supporting arm 211 is pivotally coupling with the upper end of the respective second side frame leg 112 and a free end portion of the second side supporting arm 212 is pivotally coupling with the upper end of the respective first side frame leg 111.

The tension fabric 23, which is supported on the foldable frame 10, has two side edge portions 231, 232 substantially supported by the two side supporting units 21 respectively.

According to the preferred embodiment, the first and second side supporting arms 211, 212 of each of the side supporting units 21 are pivotally connected by a pivot joint 24 in such a manner that the first and second side supporting arms 211, 212 are adapted to be pivotally folded between a folded position and an unfolded position. In which, at the folded position, the foldable frame 10 is collapsed while the first and second supporting arms 211, 212 are pivotally folded downwardly toward with each other. At the unfolded position, the foldable frame 10 is fully expanded to form a box shaped structure by the two side frames 11, the front frame 12, and the rear frame 13 while the first and second side supporting arms 211, 212 are pivotally and upwardly folded in a horizontal position to retain the foldable frame in an unfolded stretching manner.

It is worth to mention that the free end portion of the first side supporting arms 211 is adapted to pivotally connect to the rear frame joint 15 where the upper end of the respective second side frame leg 112 is pivotally connected thereto and the free end portion of the second side supporting arms 212 is adapted to pivotally connect to the front frame joint 14 wherein the upper end of the respective first side frame leg 111 is pivotally connected thereto, in such a manner that the first and second side supporting arms 211, 212 are adapted to pivotally fold in the horizontal position to retain a distance between the front and rear frame joints 14, 15 when the foldable frame 10 is unfolded.

Accordingly, a total length of the first and second side supporting arms 211, 212 of each of the side supporting units 21 must be at least equal to a distance between the corresponding front and rear frame joints 14, 15 in the unfolded position in such a manner that when the first and second side supporting arms 211, 212 are folded upwardly, the side supporting units 21 retain the distances between front and rear frame joints 14, 15 respectively so as to substantially support the foldable frame 10 in the unfolded position.

Referring to FIG. 2, the pivot joint 24 is constructed to have a first joint member 241 firmly affixed to the first side supporting arm 211 and a second joint member 242 firmly affixed to the second supporting arm 212 to pivotally connect with the first joint member 241. The first and second members 241, 242 have first and second stopper edges 2411, 2421 to limit a pivotal movement of thereof. In other words, the first joint member 241 is pivotally connected to the second joint member 242 while the first stopper edge 2411 of the first joint member 241 is arranged to limit a pivotal movement of the second joint member 242 and the second stopper edge 2421 of the second joint member 242 is arranged to limit a pivotal movement of the first joint member 241, so that the first and second side supporting arms 241, 242 are allowed to upwardly fold in a horizontal position when the foldable frame 10 is unfolded.

Figure 3:
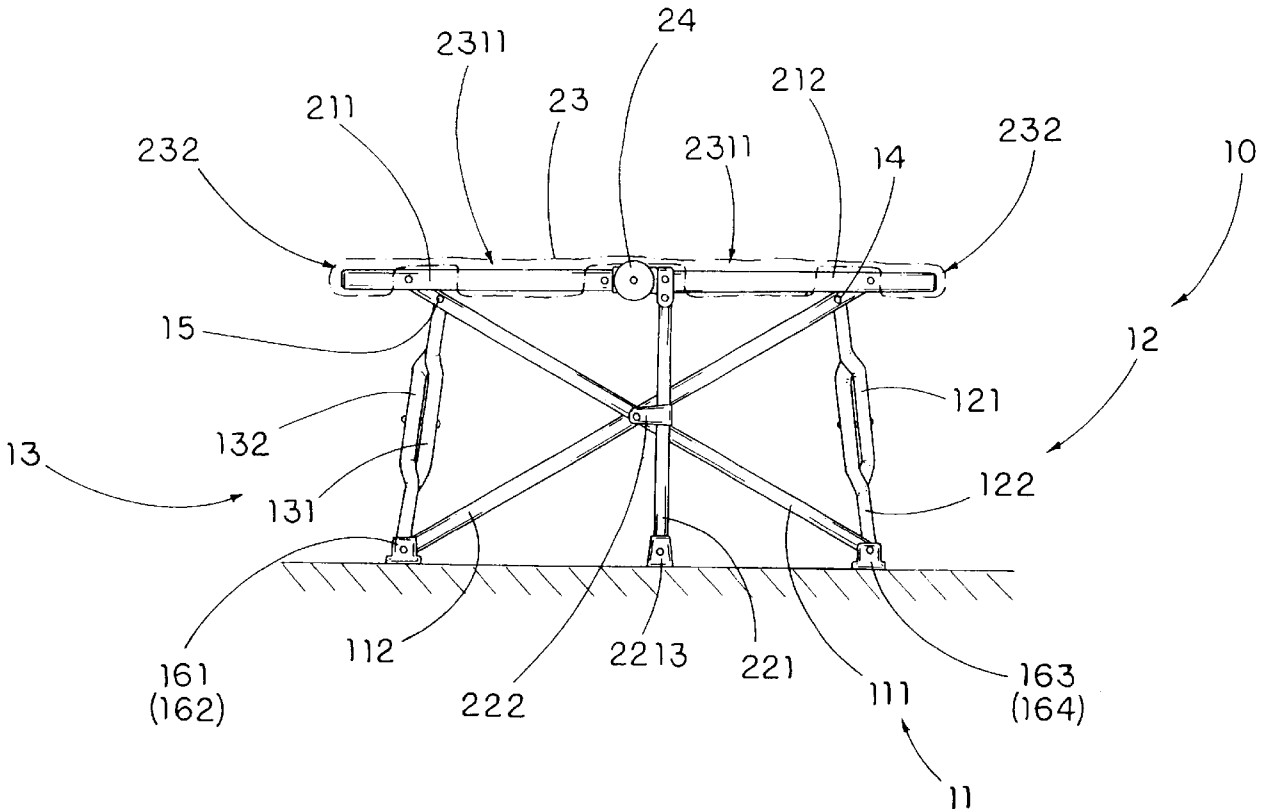
FIG. 3 is a side view of the foldable furniture with the foldable side support arrangement according to the above first preferred embodiment of the present invention.

As shown in FIGS. 1 and 3, since the two side supporting units 21 are extended along the two side portions of the tension fabric 23 respectively, the tension fabric 23 is stretched by the two side supporting units 21 in a tense manner. Therefore, when the foldable frame 10 is unfolded, the side supporting units 21 can more evenly distribute and support the downward force and stress applied on the tension fabric 23, so that the user is allowed to put more weight on the foldable furniture 1 without distorting the shape of the tension fabric 23.

As shown in FIG. 2, each of the retaining unit 22 comprises a standing leg 221 having an upper pivot end 2211 pivotally connected to the first side supporting arm 211 and a bottom supporting end 2212 downwardly extended for biasing the ground when the foldable frame 10 is in the unfolded position.

Each of the standing legs 221 has a predetermined height with respect to a height of the foldable frame 10 in the unfolded position in such a manner that when the foldable frame 10 is in the unfolded position, the standing legs 221 are adapted to substantially support the side supporting units 21 respectively, so as to prevent the first and second side supporting arms 211, 212 of the side supporting units 21 folding downwardly.

It is worth to mention that in the unfolded position, the supporting end 2212 of the standing leg 221 is substantially biased against the ground, such that the pivotal movements of the first and second side supporting arms 211, 212 are locked up so as to prevent the side supporting unit 21 from being folded up accidentally.

Moreover, each of the standing legs 221 further comprises a ground rest 2213 affixed to the supporting end 2212 of the standing leg 221 for enhancing the stabilization of the foldable frame 10 when the ground rest 2213 biases on the ground.

Each of the retaining unit 22 further comprises a guiding holder 222 arranged to guide the respective standing leg 221 between the folded position and the unfolded wherein the guiding holder 222 comprises a tubular slider body 2221 and a connecting wing 2222 integrally extended from the slider body 2222. Each of the slider bodies 2221 is rotatably mounted on a predetermined position of the side frame 11 by pivotally riveting the connecting wing 2222 to the side frame 111, wherein the slider body 2221 has an axial slider through slot 2223 which has a diameter slightly larger than a diameter of the respective standing leg 221 for the standing leg 221 slidably passing through, as shown in FIG. 2.

Accordingly, the connecting wing 2222, which is integrally extended from one side of the slider body 2221, is pivotally riveted to the side frame 11 at a position that where the first and second side frame legs 111, 112 are pivotally connected with each other.

Figure 4:
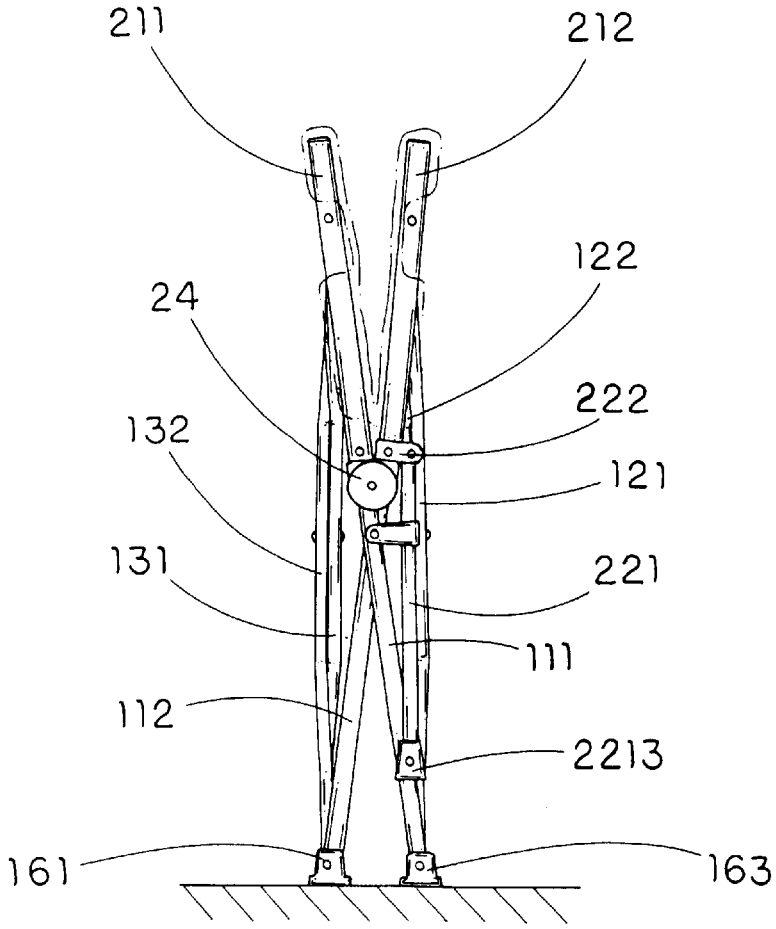
FIG. 4 is a view of the foldable furniture in a folded position according to the above first preferred embodiment of the present invention.

The guiding holder 222 is arranged to guide the standing leg 221 in a vertically movable manner between the folded position and the unfolded position. When the foldable frame 10 is folded up, the first and second side frame legs 111, 112 are pivotally folded toward each other while the standing leg 221 is upwardly slid along the guider holder 222 so as to lift up the supporting end 2212 of the standing leg 221, as shown in FIG. 4. When the foldable frame 10 is unfolded, the pivotal movements of the first and second side frame legs 111, 112 force the standing leg 221 sliding downwardly through the guiding holder 222 until the supporting end 2212 of the standing leg 221 biases on the ground, as shown in FIG. 3. It is worth to mention that the standing leg 221 is mounted to the side frame 11 in a vertically movable manner, the unfolded size of the foldable frame 10 will not increased after incorporating with the retaining unit 23.

The tension fabric 23 further comprises a pair of holding devices 231 holding the two side portions of the tension fabric 23 with the side supporting units 21 respectively. Each of the holding devices 231 comprises at least a tubular holding sleeve 2311, having two open ends, provided on each side portion of a bottom surface of the tension fabric 23 in such a manner that one of the first and second side supporting arms 211, 212 is arranged to slidably pass through the tubular holding sleeve 2311 of the holding device 231. As shown in FIGS. 1 and 3, there are two tubular holding sleeves 2311 of the holding device 231 provided on each of the side portions of the bottom surface of the tension fabric 23 for the first and second side supporting arms 211, 212 slidably passing through, so as to substantially mount the tension fabric 23 on the foldable frame 10.

As shown in FIG. 3, the tension fabric 23 further has two pairs of tubular holding pocket 232, each having an open end, provided at comer portions of the bottom surface of the tension fabric 23 respectively in such a manner that the free end portions of the first and second side supporting arms 211, 212 are arranged to slidably insert into the holding pockets 232 respectively, so as to tensely retain the tension fabric 23 by the side supporting units 21.

Practically, the downward force applied on the tension fabric 23 has a trend of pulling the two side supporting units 21 towards each other. However, each of the side supporting units 21 is substantially retained between the front and rear frame joints 14, 15 such that the downward force will be evenly distributed to the foldable frame 10 through the side supporting units 21. In other words, the side supporting units 21 can enhance the tension of the tension fabric 23 by reinforcing the two side portions thereof, that substantially increase the effective supporting contact-area of the tension fabric 23. Therefore, the foldable furniture 1 is capable of supporting more weight in comparison with the conventional furniture without the foldable side support arrangement 20.

Figure 5:
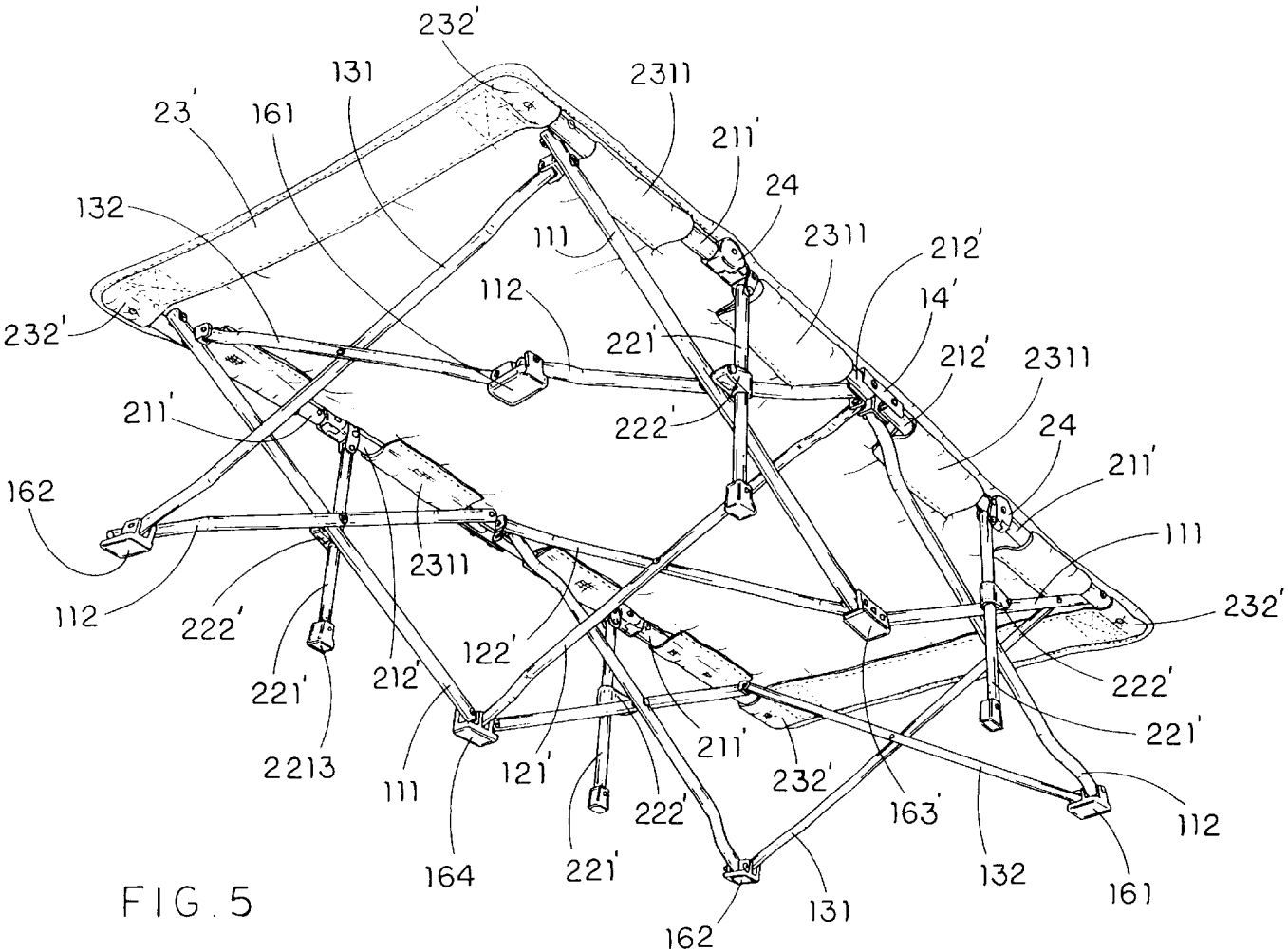
FIG. 5 is a perspective view of a foldable furniture incorporated with a foldable side support arrangement according to a second preferred embodiment of the present invention.

Referring to FIG. 5, a foldable furniture 1' according to a second embodiment illustrates an alternative mode of the first embodiment of the present invention, wherein the foldable furniture 1' of the second embodiment, which is embodied as a foldable bed, is a modification of the first embodiment.

Figure 6:
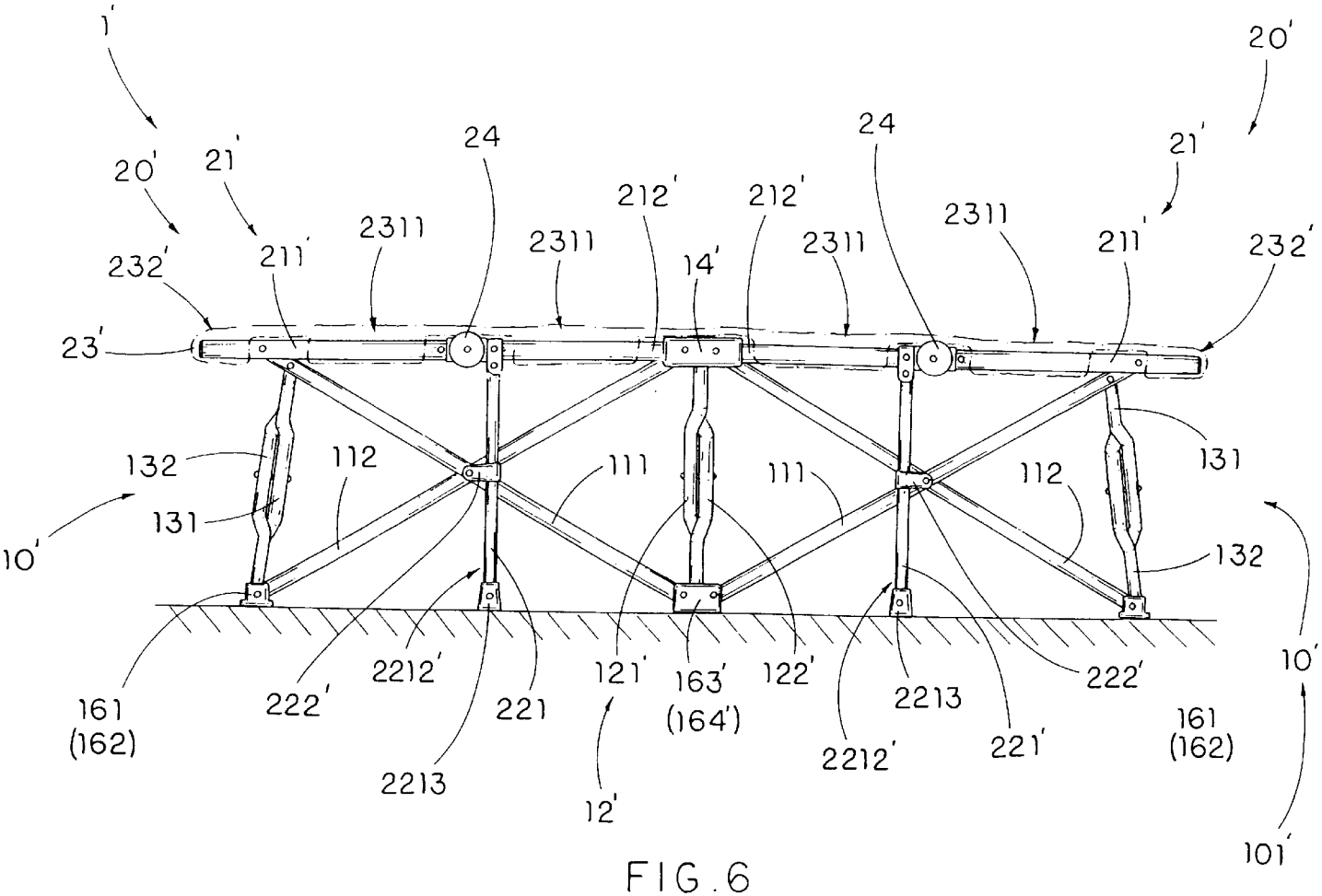
FIG. 6 is a side view of the foldable furniture with the foldable side support arrangement according to the above second preferred embodiment of the present invention.

As shown in FIGS. 5 and 6, the foldable furniture 1' comprises two identical foldable frames 10' connected with each other by integrally connecting the front frame joints 14' of the first and second foldable frames 10' together to form a foldable bed frame 101'. Moreover, the two foldable frames 10' share with one front frame 12' which comprises the first and second front frame legs 121', 122'.

Each of the foldable frame 10' comprises the foldable side support arrangement 20' wherein the two pairs of side supporting units 21' are pivotally extended at two sides of the foldable bed frame 101 ' while the free end portion of each first side supporting arm 211' is pivotally connected to the respective front frame joint 14' and the free end portion of each second side supporting arm 212' is pivotally connected to the rear frame joint 15'.

The tension fabric 23', which is supported on the foldable bed frame 101', has two side portions supported by the side supporting units 21' respectively in such a manner that the tension fabric 23' is stretched by the side supporting units 21 in a tense manner when the foldable bed frame 101' is unfolded to stretch out. Besides, the downward pulling force applied by the user' weight will distribute from the tension fabric 23' to the entire foldable bed frame 101' so that the foldable bed is more comfortable and capable of supporting more weight in comparison with the conventional foldable bed having the same foldable bed frame structure and size.

Accordingly, the tension fabric 23' comprises two pairs of holding devices 231' to hold the two side portions of the tension fabric 23' with the side supporting units 21' respectively, wherein each of the holding devices 231' comprises at least the tubular holding sleeve 2311', having two open ends, provide on each side portion of the bottom surface of the tension fabric 23' for the first and second side supporting arms 211', 212' of each of the side supporting units 21' slidably passing through, so as to mount the tension fabric 23' on the side supporting units 21' to evenly distribute the downward force on the tension fabric 23' through the entire foldable bed frame 101'.

The tension fabric 23' further has two pairs of tubular holding pockets 232', each having an open end, provided at corner portions of the bottom surface of the tension fabric 23' in such a manner that the free end portions of the second side supporting arms 212' are arranged to slidably insert into the holding pockets 232' respectively, so as to tensely retain the tension fabric 23' by the side supporting units 21'.

When the foldable bed frame 101' is unfolded to stretch out, as shown in FIG. 6, each of the guiding holder 222' is arranged to guide the respective standing leg 221' in a vertical manner, such that the supporting end 2212' of each standing leg 221' is substantially biased against the ground, so as to substantially support the foldable bed frame 101' through the side supporting units 21'.

What is claimed is:

1. A foldable furniture, comprising:

a foldable frame, which comprises:

two side frames each comprising a first side frame leg and a second side frame leg pivotally coupled with each other to form a "X" structure;

a front frame comprising a first front frame leg and a second front frame leg pivotally coupled with each other to form a "X" structure;

a rear frame comprising a first rear frame leg and a second rear frame leg pivotally coupled with each other to form a "X" structure;

a pair of front frame joints pivotally connected two upper ends of said front frame legs with two upper ends of said side frame legs respectively; and a pair of rear frame joints pivotally connected two upper ends of said rear frame legs with two upper ends of said side frame legs respectively; and a foldable side support arrangement, which comprises:

a pair of side supporting units each comprising a first and second side supporting arms pivotally connected with each other end to end wherein a free end portion of said first side supporting arm is pivotally coupling with said upper end of said respective second side frame leg and a free end portion of said second side supporting arm is pivotally coupling with said upper end of said respective first side frame leg;

means for reinforcing said side supporting units pivotally extend to retain said first and second side frame legs in position when said foldable frame is unfolded to stretch out; and a tension fabric, which is supported on said foldable frame, having two side edge portions substantially supported by said two side supporting units respectively.

2. A foldable furniture, as recited in claim 1, wherein said means comprises two retaining units coupling with said side supporting units respectively, wherein each of said retaining units comprises a standing leg having an upper pivot end pivotally connected to said first side supporting arm and a bottom supporting end downwardly extended for biasing the ground when said foldable frame is unfolded to stretch out.

3. A foldable furniture, as recited in claim 2, wherein each of said retaining units further comprises a guiding holder rotatably mounted on a predetermined position of said respective side frame, wherein each of said guiding holder comprises a slider body having a slider through slot arranged for said respective standing leg slidably passing through so as to guide said standing leg in a vertically movable manner.

4. A foldable furniture, as recited in claim 3, wherein a total length of said first and second side supporting arms of each side supporting unit is at least equal to a distance between a distance between said corresponding front and rear frame joints when said foldable frame is unfolded to stretch out, in such a manner that said first and second side supporting arms are pivotally and upwardly folded in a horizontal position so as to retain said foldable frame in an unfolded stretching manner.

5. A foldable furniture, as recited in claim 4, wherein said tension fabric further comprises a pair of holding devices to hold said two side portions of said tension fabric with said side supporting units respectively.

6. A foldable furniture, as recited in claim 5, wherein each of said holding devices comprises at least a tubular holding sleeve, having two open ends, provided on each side portion of a bottom surface of said tension fabric for first and second side supporting arms slidably passing through.

7. A foldable furniture, as recited in claim 6, wherein said tension fabric further comprises two pairs of tubular holding pocket, each having an open end, provided at corner portions of said bottom surface of said tension fabric respective in such a manner that said free end portions of said first and second side supporting arms are arranged to slidably insert into said holding pockets respectively, so as to tensely retain said tension fabric by the side supporting units.

8. A foldable furniture, as recited in claim 3, wherein each of said guiding holder further comprises a connecting wing, which is integrally extended from one side of said respective slider body, pivotally riveted to said respective side frame at a position where said first and second side frame legs are pivotally connected with each other.

9. A foldable furniture, as recited in claim 8, wherein a total length of said first and second side supporting arms of each side supporting unit is at least equal to a distance between a distance between said corresponding front and rear frame joints when said foldable frame is unfolded to stretch out, in such a manner that said first and second side supporting arms are pivotally and upwardly folded in a horizontal position so as to retain said foldable frame in an unfolded stretching manner.

10. A foldable furniture, as recited in claim 9, wherein said tension fabric further comprises a pair of holding devices to hold said two side portions of said tension fabric with said side supporting units respectively.

11. A foldable furniture, as recited in claim 10, wherein each of said holding devices comprises at least a tubular holding sleeve, having two open ends, provided on each side portion of a bottom surface of said tension fabric for first and second side supporting arms slidably passing through.

12. A foldable furniture, as recited in claim 11, wherein said tension fabric further comprises two pairs of tubular holding pocket, each having an open end, provided at corner portions of said bottom surface of said tension fabric respective in such a manner that said free end portions of said first and second side supporting arms are arranged to slidably insert into said holding pockets respectively so as to tensely retain said tension fabric by the side supporting units.

13. A foldable furniture, as recited in claim 12, wherein each of said side supporting units further comprises a pivot joint pivotally connecting said first and second side supporting arms with each other, wherein said pivot joint comprises a first joint member, having a stopper edge, firmly affixed to said first side supporting arm and a second joint member, having a second stopper edge, firmly affixed to said second side supporting arm, said first joint member being pivotally connected to said second joint member while said first stopper edge of said first joint member is arranged to limit a pivotal movement of said second joint member and said second stopper edge of said second joint member is arranged to limit a pivotal movement of said first joint member, so that said first and second side supporting arms are allowed to upwardly fold in a horizontal position when said foldable frame is unfolded.

14. A foldable furniture, as recited in claim 4, wherein each of said side supporting units further comprises a pivot joint pivotally connecting said first and second side supporting arms with each other, wherein said pivot joint comprises a first joint member, having a stopper edge, firmly affixed to said first side supporting arm and a second joint member, having a second stopper edge, firmly affixed to said second side supporting arm, said first joint member being pivotally connected to said second joint member while said first stopper edge of said first joint member is arranged to limit a pivotal movement of said second joint member and said second stopper edge of said second joint member is arranged to limit a pivotal movement of said first joint member, so that said first and second side supporting arms are allowed to upwardly fold in a horizontal position when said foldable frame is unfolded.

15. A foldable furniture, as recited in claim 9, wherein each of said side sup porting units further comprises a pivot joint pivotally connecting said first and second side supporting arms with each other, wherein said pivot joint comprises a first joint member, having a stopper edge, firmly affixed to said first side supporting arm and a second joint member, having a second stopper edge, firmly affixed to said second side supporting arm, said first joint member being pivotally connected to said second joint member while said first stopper edge of said first joint member is arranged to limit a pivotal movement of said second joint member and said second stopper edge of said second joint member is arranged to limit a pivotal movement of said first joint member, so that said first and second side supporting arms are allowed to upwardly fold in a horizontal position when said foldable frame is unfolded.

16. A foldable furniture, as recited in claim 3, wherein said tension fabric further comprises a pair of holding devices to hold said two side portions of said tension fabric with said side 'supporting units respectively.

17. A foldable furniture, as recited in claim 16, wherein each of said holding devices comprises at least a tubular holding sleeve, having two open ends, provided on each side portion of a bottom surface of said tension fabric for first and second side supporting arms slidably passing through.

18. A foldable furniture, as recited in claim 16, wherein said tension fabric further comprises two pairs of tubular holding pocket, each having an open end, provided at corner portions of said, bottom surface of said tension fabric respective in such a manner that said free end portions of said first and second side supporting arms are arranged to slidably insert into said holding pockets respectively, so as to tensely retain said tension fabric by the side supporting units.

19. A foldable furniture, as recited in claim 1, wherein a total length of said first and second side supporting arms of each side supporting unit is at least equal to a distance between a distance between said corresponding front and rear frame joints when said foldable frame is unfolded to stretch out, in such a manner that said first and second side supporting arms are pivotally and upwardly folded in a horizontal position so as to retain said foldable frame in an unfolded stretching manner.

20. A foldable furniture, as recited in claim 1, wherein each of said side supporting units further comprises a pivot joint pivotally connecting said first and second side supporting arms with each other, wherein said pivot joint comprises a first joint member, having a stopper edge, firmly affixed to said first side supporting arm and a second joint member, having a second stopper edge, firmly affixed to said second side supporting arm, said first joint member being pivotally connected to said second joint member while said first stopper edge of said first joint member is arranged to limit a pivotal movement of said second joint member and said second stopper edge of said second joint member is arranged to limit a pivotal movement of said first joint member, so that said first and second'side supporting arms are allowed to upwardly fold in a horizontal position when said foldable frame is unfolded.

* * * * *